US008777129B2

(12) United States Patent
Hashish et al.

(10) Patent No.: US 8,777,129 B2
(45) Date of Patent: Jul. 15, 2014

(54) APPARATUS AND PROCESS FOR FORMATION OF LATERALLY DIRECTED FLUID JETS

(71) Applicant: Flow International Corporation, Kent, WA (US)

(72) Inventors: Mohamed Hashish, Bellevue, WA (US); Steve Craigen, Auburn, WA (US); Bruce Schuman, Auburn, WA (US); Eckhardt Ullrich, Kent, WA (US); Jeno Orova, Maple Valley, WA (US)

(73) Assignee: Flow International Corporation, Kent, WA (US)

( * ) Notice: Subject to any disclaimer, the term of this patent is extended or adjusted under 35 U.S.C. 154(b) by 0 days.

(21) Appl. No.: 13/725,239

(22) Filed: Dec. 21, 2012

(65) Prior Publication Data

US 2013/0122791 A1 May 16, 2013

Related U.S. Application Data

(63) Continuation of application No. 11/901,961, filed on Sep. 18, 2007, now Pat. No. 8,448,880.

(51) Int. Cl.

| | |
|---|---|
| ***B05B 7/04*** | (2006.01) |
| ***B05B 7/08*** | (2006.01) |
| ***B24C 5/04*** | (2006.01) |

(52) U.S. Cl.

USPC ..... 239/434; 239/426; 451/102

(58) Field of Classification Search

USPC ..... 239/398, 400, 428, 434, 407, 410, 413, 239/426, 429, 433; 451/36, 40, 102

See application file for complete search history.

(56) References Cited

U.S. PATENT DOCUMENTS

| | | | | |
|---|---|---|---|---|
| RE23,064 | E | | 12/1948 | Tirrell |
| 2,577,465 | A | * | 12/1951 | Jones et al. ..... 451/90 |
| 3,624,966 | A | * | 12/1971 | Palmer ..... 451/90 |
| 4,478,368 | A | | 10/1984 | Yie |
| 4,555,872 | A | | 12/1985 | Yie |
| 4,848,042 | A | | 7/1989 | Smith et al. |
| 4,934,111 | A | | 6/1990 | Hashish et al. |
| 4,936,512 | A | | 6/1990 | Tremoulet, Jr. |
| 4,951,429 | A | | 8/1990 | Hashish et al. |
| 4,955,164 | A | | 9/1990 | Hashish et al. |
| 5,018,670 | A | | 5/1991 | Chalmers |
| 5,092,085 | A | | 3/1992 | Hashish et al. |
| 5,144,766 | A | | 9/1992 | Hashish et al. |
| 5,320,289 | A | | 6/1994 | Hashish et al. |
| 5,512,318 | A | | 4/1996 | Raghavan et al. |
| 5,643,058 | A | | 7/1997 | Erichsen et al. |
| 5,851,139 | A | | 12/1998 | Xu |

(Continued)

FOREIGN PATENT DOCUMENTS

| | | |
|---|---|---|
| DE | 10225304 A1 | 12/2003 |
| DE | 20 2005 018 108 U1 | 2/2006 |

(Continued)

*Primary Examiner* — Justin Jonaitis

(74) *Attorney, Agent, or Firm* — Seed IP Law Group

(57) ABSTRACT

A processing apparatus is provided to process a workpiece. The processing apparatus can have a low-profile nozzle system capable of navigating through spaces in order to process target regions with relatively small clearances. A fluid jet outputted from the nozzle system is used to cut, mill, or otherwise process the target region of the workpiece.

26 Claims, 13 Drawing Sheets

(56) References Cited

U.S. PATENT DOCUMENTS

| | | | | |
|---|---|---|---|---|
| 6,000,308 | A | 12/1999 | LaFountain et al. | |
| 6,280,302 | B1 | 8/2001 | Hashish et al. | |
| 6,283,832 | B1 | 9/2001 | Shepherd | |
| 6,308,434 | B1 | 10/2001 | Chickering, III et al. | |
| 6,328,638 | B1 | 12/2001 | Hopkins et al. | |
| 6,383,062 | B1 * | 5/2002 | Jou | 451/90 |
| 6,464,567 | B2 | 10/2002 | Hashish et al. | |
| 6,607,428 | B2 | 8/2003 | Tolles | |
| 6,752,686 | B1 | 6/2004 | Hashish et al. | |
| 6,755,725 | B2 | 6/2004 | Hashish et al. | |
| 6,875,084 | B2 | 4/2005 | Hashish et al. | |
| 6,932,285 | B1 | 8/2005 | Zeng | |
| 6,939,205 | B2 | 9/2005 | Hopf et al. | |
| 6,945,859 | B2 | 9/2005 | Hashish et al. | |
| 7,341,504 | B1 * | 3/2008 | Chen | 451/90 |
| 2001/0037821 | A1 | 11/2001 | Staley et al. | |
| 2004/0107810 | A1 | 6/2004 | Sciulli et al. | |
| 2007/0165060 | A1 * | 7/2007 | Helmig et al. | 347/20 |

FOREIGN PATENT DOCUMENTS

| | | | |
|---|---|---|---|
| EP | 0248638 | A2 | 12/1987 |
| JP | 63-154156 | U | 10/1988 |
| JP | 02-059267 | A | 2/1990 |
| JP | 4-102776 | U | 9/1992 |
| JP | 04-372399 | | 12/1992 |
| JP | 06-328365 | | 11/1994 |
| JP | 07-171799 | A | 7/1995 |
| JP | 11-347938 | A | 12/1999 |
| TW | 289003 | | 10/1996 |
| TW | 421619 | A | 2/2001 |
| TW | 470689 | B | 1/2002 |
| TW | 553770 | B | 9/2003 |
| TW | 555615 | B | 10/2003 |
| TW | 581716 | B | 4/2004 |
| WO | 0044292 | A1 | 8/2000 |
| WO | 00/56466 | A2 | 9/2000 |
| WO | 03011524 | A1 | 2/2003 |

* cited by examiner

APPARATUS AND PROCESS FOR FORMATION OF LATERALLY DIRECTED FLUID JETS

CROSS-REFERENCE TO RELATED APPLICATIONS

This application is a Continuation of U.S. patent application Ser. No. 11/901,961, filed Sep. 18, 2007, where this application is incorporated herein by reference in its entirety.

BACKGROUND OF THE INVENTION

1. Field of the Invention

The present invention relates generally to processes and apparatuses for generating fluid jets, and in particular, processes and apparatuses for generating laterally directed high-pressure fluid jets.

2. Description of the Related Art

Conventional fluid jet systems have been used to clean, cut, or otherwise process workpieces by pressurizing fluid and then delivering the pressurized fluid against workpieces. Fluid jet systems often have straight nozzle systems that require significant operating clearance around the target workpiece and, consequently, may be unsuitable for processing workpieces in remote locations or within confined spaces.

For example, nozzle systems are often slender and have large axial lengths rendering them unsuitable for processing many types of workpieces. A conventional nozzle system may have a long straight feed tube, a cutting head and a long straight mixing tube aligned with and downstream of the feed tube. A jewel orifice may be positioned between the feed tube and the mixing tube within the cutting head. During processing, fluid flows along an extremely long linear path extending through the linearly arranged feed tube, orifice, and mixing tube.

Fluid jets can be used to process various types of workpieces, such as aircraft components. Unfortunately, numerous locations of aircraft components may provide minimal amounts of clearance. It may be difficult or impossible to adequately process these areas due to the large overall axial length of conventional fluid jet nozzle systems. For example, aircraft stringers may have flanges about 1.5 inches from one another. Conventional nozzles have axial lengths that are greater than 1.5 inches and, consequently, are unsuitable for use in such tight spaces. Other types of workpieces may likewise have features that cannot be adequately accessed with traditional fluid jet systems.

The present disclosure is directed to overcome one or more of the shortcomings set forth above, and/or provide further unrelated or related advantages.

BRIEF SUMMARY OF THE INVENTION

Some embodiments disclosed herein include the development of a fluid jet delivery system having a nozzle system dimensioned to fit into relatively small spaces. For example, a low-profile nozzle system of a fluid jet delivery system can be navigated through narrow spaces to access a target region, even remote interior regions of a workpiece. Low-profile nozzle systems can fit within various features including, without limitation, apertures, bores, channels, gaps, chambers, cavities, and the like, as well as other features that may provide access to a target site. During a single processing sequence, the nozzle system can pass through any number of features with varying sizes and geometries.

Nozzle systems disclosed herein can output a fluid jet at an orientation based on one or more processing criteria, such as a desired stand-off distance. Different nozzle systems can output fluid jets at different orientations. Even though two nozzle systems may have the same or similar outer dimensions, the two nozzle systems can deliver fluid jets at different orientations.

The nozzle systems in some embodiments can output a fluid jet in a lateral direction with respect to a direction of travel of the feed fluid flow. Because the fluid jet is directed laterally outward, the nozzle system can be inserted into and operated within relatively small spaces. The fluid flow within the nozzle system can be redirected one or more times in order to reduce selected dimensions of the nozzle system. In some embodiments, the fluid flow upstream of a nozzle orifice is redirected one time using, for example, an angled conduit.

In some embodiments, a primary direction of travel of the feed fluid flow upstream of the nozzle orifice is not aligned with respect to a secondary direction of travel of the fluid flow downstream of the orifice. In some embodiments, for example, the sum of the vectors of the flow velocity of the fluid jet exiting the nozzle orifice is not aligned with the sum of the vectors of the flow velocity of the fluid flow in a feed fluid conduit that is upstream of the nozzle orifice.

In some embodiments, nozzle systems can include one or more secondary flow ports positioned at various locations along a flow path in the nozzle system. Fluids (e.g., water, saline, air, gases, and the like), media, etchants, and other substances suitable for delivery via the nozzle system can be delivered through the secondary flow ports so as to alter one or more desired flow criteria, including, without limitation, coherency of the fluid jet, dispersion of the fluid jet, proportions of the constituents of the fluid jet (either by weight or by volume), flow turbulence, spreading of the fluid jet, or other flow characteristics, as well as other flow parameters related to the performance of fluid jets. The secondary flow ports can be oriented perpendicularly or obliquely with respect to the direction of flow of the fluid passing through the conduit into which the secondary flow ports feed.

In some embodiments, a fluid jet delivery system for generating a high-pressure abrasive fluid jet comprises a media delivery system configured to output abrasive media, a fluid delivery system configured to output fluid, and a nozzle system. The nozzle system includes a media inlet in fluid communication with the media delivery system, a fluid inlet in fluid communication with the fluid delivery system, a nozzle orifice in fluid communication with the fluid inlet and configured to generate a fluid jet using fluid flowing through the fluid inlet, and a delivery conduit through which the fluid jet generated by the nozzle orifice passes. The delivery conduit comprises an outlet through which the fluid jet exits the nozzle system. The nozzle system further comprises a fluid flow conduit and a media flow conduit. The fluid flow conduit extends between the fluid inlet and the outlet of the delivery conduit. The fluid flow conduit has an upstream section and a downstream section. The nozzle orifice is interposed between the upstream and downstream sections such that fluid in the upstream section passes through the nozzle orifice to generate the fluid jet in the downstream section. The upstream section comprises a flow redirector that receives fluid flow traveling in a first direction and outputs the fluid flow in a second direction towards the nozzle orifice. The first direction is substantially different than the second direction. The media flow conduit extends between the media inlet and the downstream section of the fluid flow conduit such that abrasive media passing through the media conduit is mixed with the fluid jet, generated by the nozzle orifice, passing along the downstream section of the fluid flow conduit.

In some other embodiments, a fluid jet delivery system for producing a high-pressure abrasive fluid jet comprises a nozzle system for generating a high-pressure abrasive fluid jet. The nozzle system comprises a fluid feed conduit, nozzle orifice, a media feed conduit, and an outlet. The fluid feed conduit includes a first section, a second section, and a flow redirector between the first and second sections. The flow redirector is configured to receive a fluid flow traveling in a first direction through the first section and to direct the fluid flow in a second direction angled with respect to the first direction. The nozzle orifice is downstream of the second section of the fluid feed conduit and configured to generate a fluid jet. Abrasive is delivered through the media feed conduit into a fluid jet generated by the nozzle orifice so as to form a high-pressure abrasive media fluid jet. The high-pressure abrasive media fluid jet exits the nozzle system via the outlet.

In some embodiments, a method for producing a high-pressure abrasive water jet with a nozzle system is provided. The method comprises passing a fluid flow through an upstream section of a feed fluid conduit of the nozzle system. The fluid flow is passed through an angled section of the feed fluid conduit such that the fluid flow delivered out of the angled section is traveling in a different direction than the fluid flow upstream of the angled section. The fluid flow is also passed through a nozzle orifice. The nozzle orifice is positioned downstream of the angled section of the feed fluid conduit. A flow of abrasive media is delivered towards the fluid flow exiting the nozzle orifice so as to form a high-pressure abrasive water jet.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles may not be drawn to scale, and some of these elements may be arbitrarily enlarged and positioned to improve drawing legibility.

DETAILED DESCRIPTION OF THE INVENTION

The following description relates to processes and systems for generating and delivering fluid jets suitable for cleaning, abrading, cutting, milling, or otherwise processing workpieces. The fluid jets can be used to conveniently process a wide range of features having different shapes, sizes, and access paths. For example, a fluid jet delivery system can have a nozzle system for delivery through deep or narrow openings, channels, or holes, as well as other difficult to access locations, in addition to easily accessible locations (e.g., an exterior surface of a workpiece). Fluid jet delivery systems with low-profile nozzle systems are disclosed in the context of processing regions of workpieces with minimal clearances because they have particular utility in this context. For example, low-profile nozzle systems can be navigated into and through relatively small spaces in order to access and then process remote interior regions of the workpiece.

Unless the context requires otherwise, throughout the specification and claims which follow, the word "comprise" and variations thereof, such as, "comprises" and "comprising" are to be construed in an open, inclusive sense, that is as "including, but not limited to."

As used in this specification and the appended claims, the singular forms "a," "an," and "the" include plural referents unless the context clearly dictates otherwise. Thus, for example, reference to a nozzle system including "a port" includes a single port, or two or more ports. It should also be noted that the term "or" is generally employed in its sense including "and/or" unless the context clearly dictates otherwise.

Figure 1:
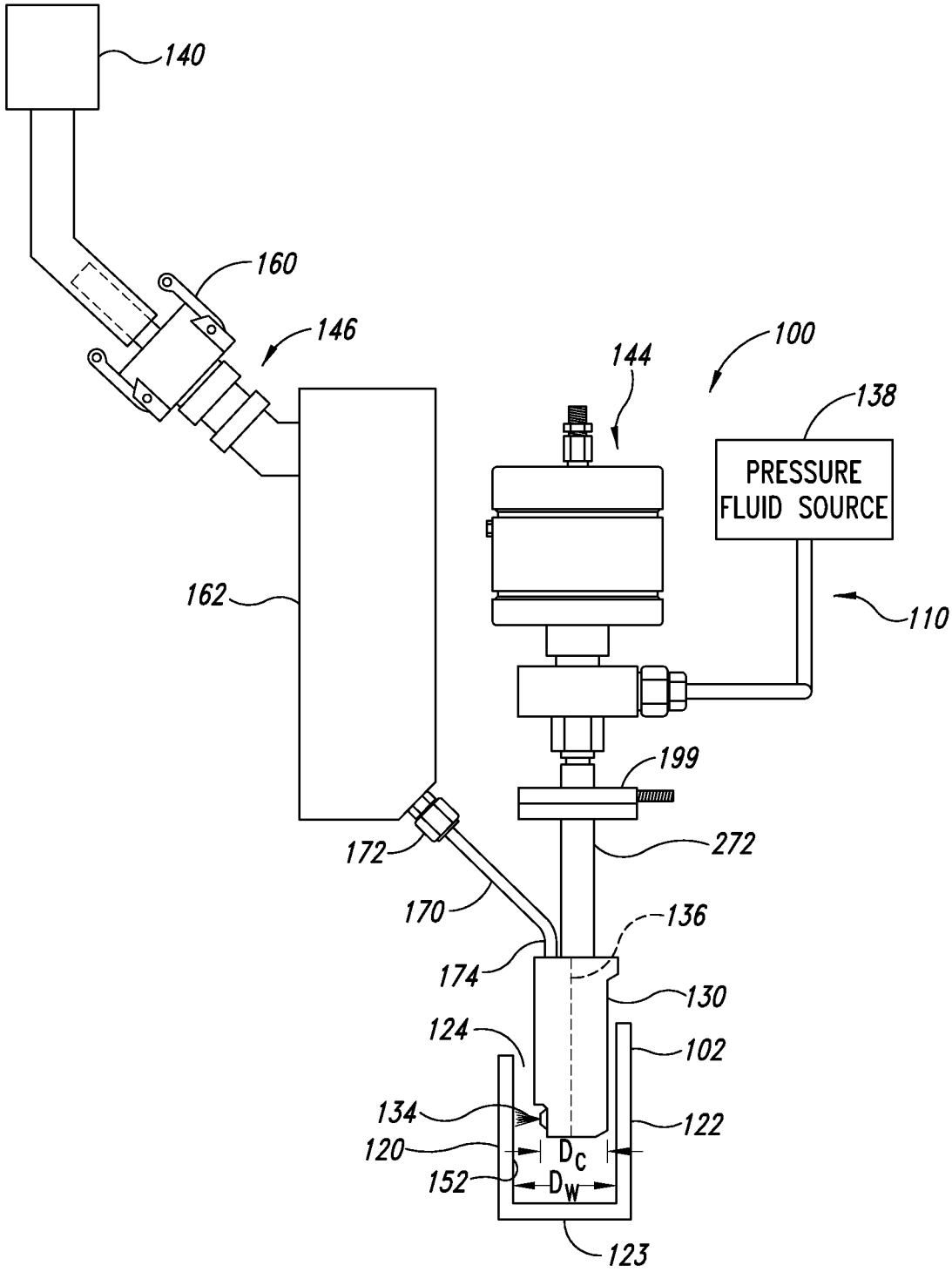
FIG. 1 is an elevational view of a fluid jet delivery system processing a workpiece, in accordance with one illustrated embodiment.

FIG. 1 shows a fluid jet delivery system 100 for processing a workpiece 102, illustrated as a generally U-shaped member with opposing sidewalls 120, 122 that define a somewhat narrow channel 124. Generally, the fluid jet delivery system 100 includes a low-profile nozzle system 130 configured to generate a fluid jet 134 capable of processing a wide range of materials. The fluid jet 134 can be oriented at a selected angle with respect to the direction of travel of the fluid flow in the nozzle system upstream of the nozzle orifice and/or the direction of motion of the nozzle system.

The illustrated fluid jet 134 is aimed in a direction that is not aligned with respect to a longitudinal axis 136 of the nozzle system 130, thereby reducing the operating clearance of the nozzle system 130 as compared to operating clearance of conventional nozzles. The nozzle system 130 can have a relative small dimension $D_C$ to reduce the clearance necessary to process the workpiece 102 and, in some embodiments, also to reduce a distance between a rearward portion of the nozzle system 130 and the surface 152 being processed. The dimension $D_C$ can be smaller than a longitudinal length of a linearly arranged conventional nozzle. As used herein, and as discussed below, the term "fluid jet" may refer to a jet comprising only fluid (or mixture of fluids) or a media fluid jet comprising both fluid and media. A fluid jet comprising only fluid may be well suited for effectively cleaning or texturing a substrate. A media fluid jet can include media (e.g., abrasive particles) entrained in various types of fluids, as detailed further below. A media fluid jet comprising media in the form of abrasive may be generally referred to as an abrasive fluid jet.

The fluid jet delivery system 100 can include a pressure fluid source 138 configured to pressurize a fluid used to produce the fluid jet 134 and a media source 140 configured to provide media. In some embodiments, including the illustrated embodiment of FIG. 1, pressurized fluid from the pressure fluid source 138 flows through a fluid delivery system 144 and into the nozzle system 130. Media from the media source 140 flows through a media delivery system 146 and into the nozzle system 130. The nozzle system 130 combines the media and fluid and then generates the outwardly directed fluid jet 134 in the form of an abrasive fluid jet (illustrated in a generally horizontal orientation).

Although the illustrated nozzle system 130 is positioned between the sidewalls 120, 122 and extends vertically, the nozzle system can be at other orientations. The media delivery system 146, the fluid delivery system 144, and the nozzle system 130 can cooperate to generate fluid jets at various orientations, and can also achieve a wide range of flow parameters of the fluid jet, including, without limitation, volumetric flow rate, flow velocity, level of homogeneity of the fluid jet 134, composition of the fluid jet 134 (e.g., ratio of media to pressurized fluid), and combinations thereof.

Various types of workpieces can be processed with the fluid jet delivery system 100. The illustrated workpiece 102 of FIG. 1 has the pair of spaced apart sidewalls 120, 122 and a base 123 extending between the sidewalls 120, 122. The nozzle system 130 is positioned in the channel 124 having a relatively small width $D_w$. Such channels 124 are unsuitable for receiving traditional nozzle systems with heights greater than the width $D_w$. The nozzle system 130 can remain spaced from the sidewalls 120, 122 while the fluid jet 134 is delivered against the surface 152 to be processed. Because the nozzle system 130 has a relatively small dimension $D_c$, the nozzle system 130 can be conveniently navigated through the channel 124 without contacting, and possible damaging or marring, one or both of the sidewalls 120, 122, even while maintaining desirable stand-off distances.

The workpiece 102 can be formed, in whole or in part, of one or more metals (e.g., steel, titanium, aluminum, and the like), composites (e.g., fiber reinforced composites, ceramic-metal composites, and the like), polymers, plastics, or ceramics, as well as other materials that can be processed with a fluid jet. The subsystems, subassemblies, components, and features of the fluid jet delivery system 100 discussed below can be modified or altered based on the configuration of the workpiece and features to be processed.

The orientation of the nozzle system 130 can be selected based on the access paths for reaching the target region. Accordingly, it will be appreciated that the nozzle system 130 can be in a variety of desired orientations, including generally vertically (illustrated in FIG. 1), generally horizontally (see, e.g., FIGS. 8, 9, and 18), or any orientation therebetween. Thus, the nozzle system 130 can be in a wide range of different positions during a processing routine.

The nozzle system 130 of FIG. 1 can be for ultrahigh-pressures, medium pressures, low pressures, or combinations thereof. Ultrahigh-pressure nozzle systems can operate at pressures equal to or greater than about 40,000 psi (276 MPa). Ultrahigh-pressure nozzles are especially well suited to cut or to mill hard materials (e.g., metals such as steel or aluminum). The illustrated workpiece 102 can comprise a hard material, which is rapidly cut with the ultrahigh fluid jet. Medium pressure nozzles can operate at a pressure in the range of about 15,000 psi (103 MPa) to about 40,000 psi (276 MPa). Medium pressure nozzles operating at a pressure below 40,000 psi (276 MPa) are especially well suited to process soft materials, such as plastic materials. Low pressure nozzles can operate at a pressure lower than about 15,000 psi (103 MPa). The nozzle system 130 can also be used with fluid at other working pressures.

With continued reference to FIG. 1, the media source 140 can contain media in the form of an abrasive that is ultimately entrained in the fluid jet 134. Although many different types of abrasives may be used, some embodiments use particles on the order of about 120 mesh or finer. For example, in some embodiments, the particles (e.g., garnet) are on the order of about 80 mesh or finer. The particular size of the abrasives can be selected based on the rate of abrasion, rate of cutting, desired surface texture, and the like. The abrasive can be dry or wet (e.g., a wet abrasive in a slurry form) depending on whether the fluid jet 134 abrades, textures, cuts, etch, polishes, cleans, or performs another procedure. The media source 140 can also have other types of media. For example, the media in the source 140 can be a fluid (e.g., liquid, gas, or mixture thereof) used to clean, polish, cut, etch, and the like. For example, the media can be an etching fluid or acid (e.g., hydrochloric acid, nitric acid, hydrofluoric acid, sulfuric acid, fluorosulfuric acid, and other fluids capable of removing material from the workpiece).

The illustrated media delivery system 146 extends from the media source 140 to the nozzle system 130 and, in one embodiment, includes an intermediate conduit 160 extending between the media source 140 and an optional air isolator 162. As shown in FIGS. 1-3A, media feed line 170 has an upstream end 172 and a downstream end 174 coupled to the air isolator 162 and a media inlet 200 of the nozzle system 130 (FIG. 3A), respectively. Media from the media source 140 can pass through the intermediate conduit 160, air isolator 162, and feed line 170 and then into the media inlet 200.

The media flow rate into the nozzle system 130 can be increased or decreased based on the manufacturing process. In some embodiments, the media is abrasive and the abrasive flow rate is equal to or less than about 7 lb/min (3.2 kg/min), 5 lb/min (2.3 kg/min), 1 lb/min (0.5 kg/min), or 0.5 lb/min (0.23 kg/min), or ranges encompassing such flow rates. In some embodiments, the abrasive flow rate is equal to or less than about 1 lb/min to produce the abrasive fluid jet 134 that is especially well suited for accurately processing targeted material with minimal impact to other untargeted material in proximity to the targeted material.

An actuation system can translate and/or rotate the nozzle system 130 as desired or needed. In some embodiments, including the illustrated embodiment of FIG. 1, an actuation system 199 is provided for selectively moving the nozzle assembly 130 with respect to the workpiece 102. The actuation system 199 can be in the form of an X-Y-Z positioning table driven by a pair of drive mechanisms. The positioning table can have any number of degrees of freedom. Motors (e.g., stepper motors) can drive the table to control the movement of the nozzle system 130. Other types of positioning systems employing linear slides, rail systems, motors, and the like can be used to selectively move and actuate the nozzle system 130 as needed or desired. U.S. Pat. No. 6,000,308, which is herein incorporated by reference in its entirety, discloses systems, components, and mechanisms that can be used to control the nozzle system 130.

Figure 2:
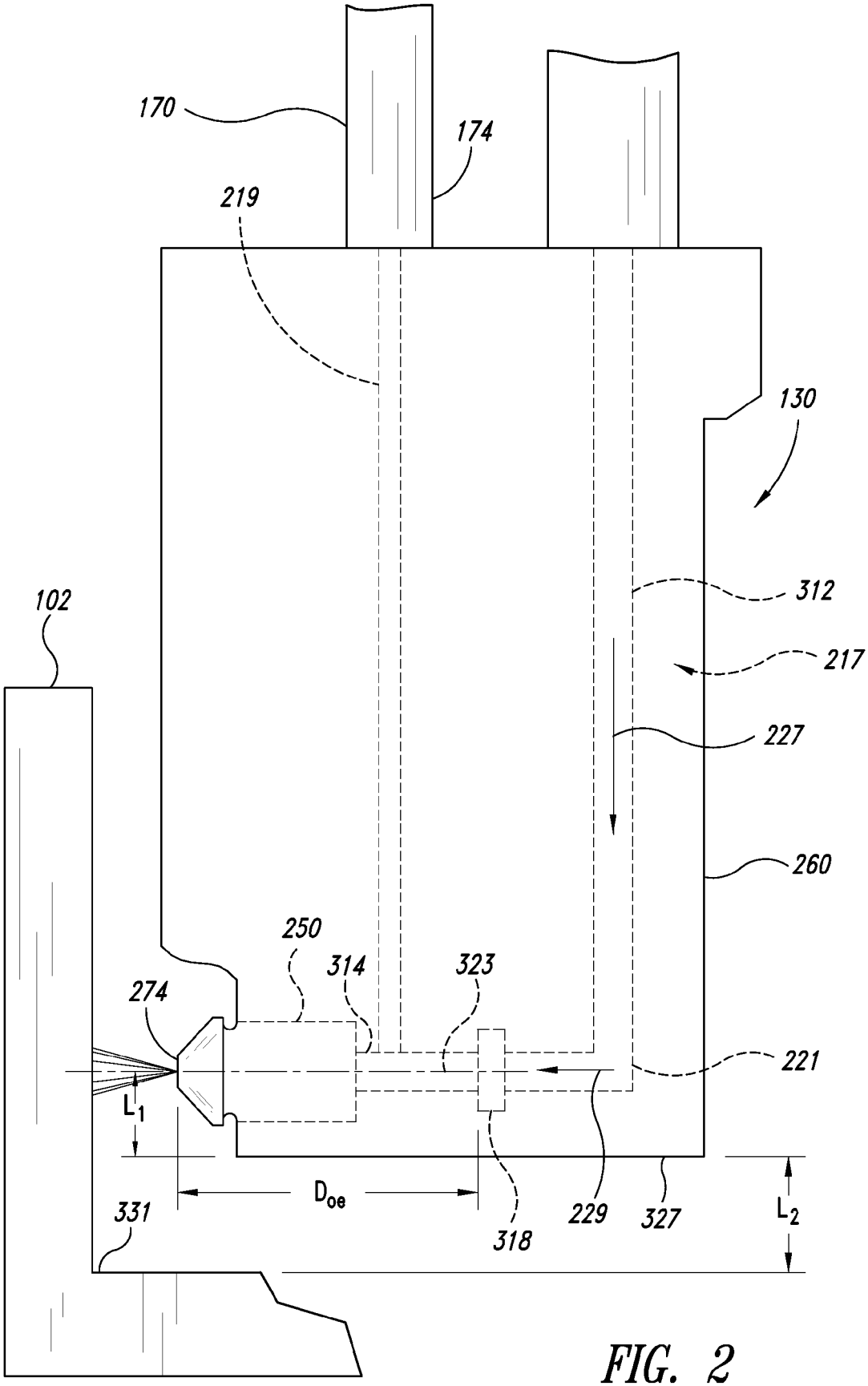
FIG. 2 is a side elevational view of a low-profile nozzle system, wherein some internal components of the nozzle system are in phantom line.
Figure 3A:
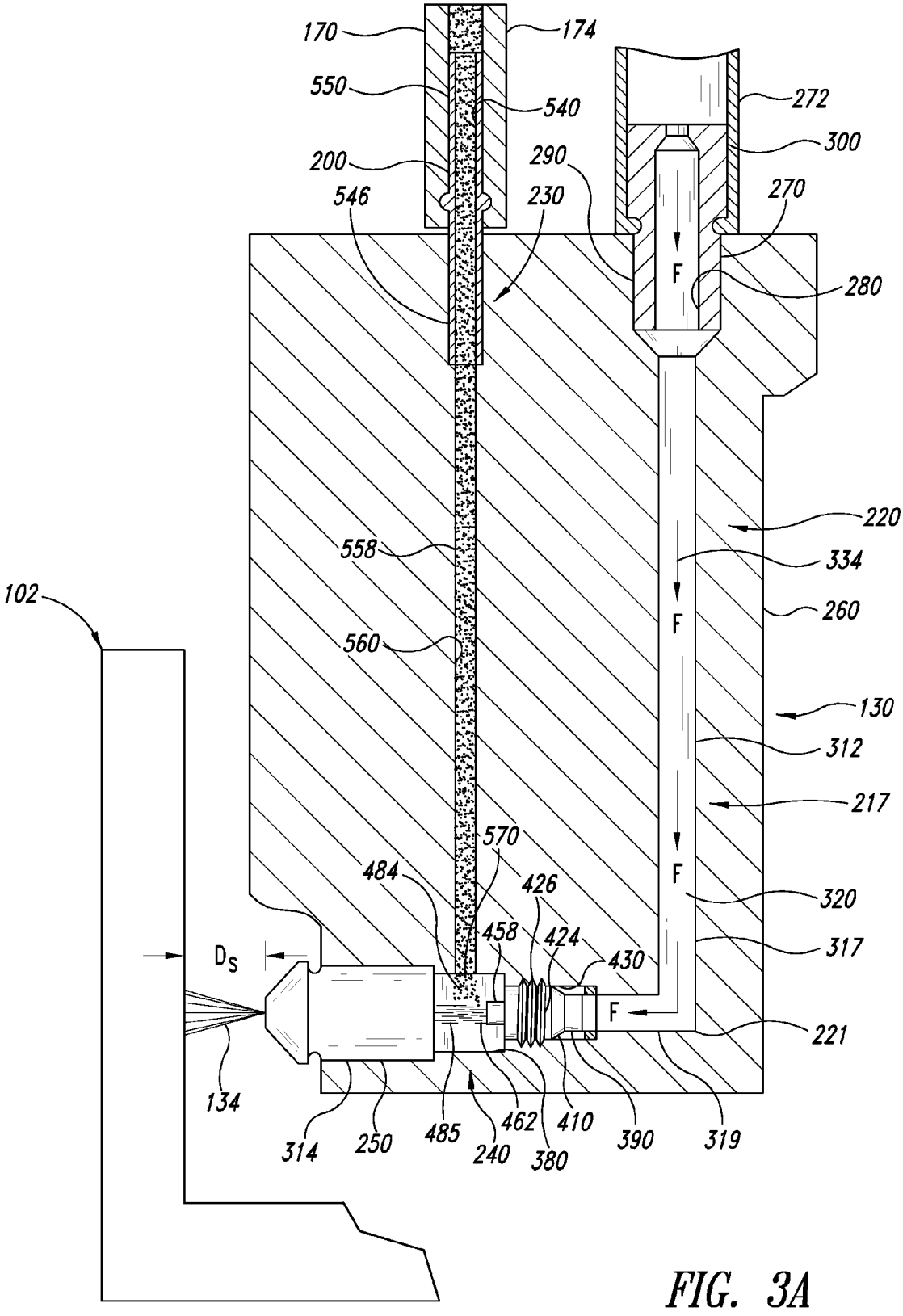
FIG. 3A is a partial cross-sectional view of a low-profile nozzle system for a fluid jet delivery system, in accordance with one embodiment.

FIG. 2 shows the nozzle system 130 including a fluid flow conduit 217 and a media flow conduit 219. As used herein, the term "conduit" is a broad term and includes, but is not limited to, a tube, hose, bore, channel, or other structure suitable for conveying a substance, such as fluid or media. A nozzle main body 260 itself can define at least a portion of the fluid flow conduit 217. For example, material can be removed from the nozzle main body 260 to form a section of the fluid flow conduit 217 positioned upstream of an angled flow redirector 221. The illustrated fluid flow conduit 217 of FIG. 2 includes an L-shaped upstream section 312 and a downstream section 314. The upstream section 312 of the fluid flow conduit 217 can include the flow redirector 221 in the form of an elbow. FIGS. 2 and 3A show the fluid flow conduit 217 extending between the fluid inlet 270 and the mixing assembly 240.

The flow redirector 221 of FIGS. 2 and 3A is a non-linear section (e.g., an angled section) of the fluid flow conduit 217 formed via a bending process. In some embodiments, the flow redirector 221 is an angle elbow or other type of fixed or variable fitting. Thus, the flow redirector 221 and upstream and downstream sections 312, 314 can have a one-piece or multi-piece construction.

The flow redirector 221 of FIG. 2 can receive fluid passing through the upstream section 312 in a first direction (indicated by the arrow 227) and output the fluid in a second direction (indicated by the arrow 229) towards a nozzle orifice 318. The downstream section 314 extends between an outlet 274 and the nozzle orifice 318. The nozzle orifice 318 is positioned between the upstream and downstream sections 312, 314 such that fluid from the upstream section 312 passes through the nozzle orifice 318 to generate the fluid jet passing into the downstream section 314.

A distance $D_{OE}$ between the nozzle orifice 318 and the outlet 274 can be selected based on the amount of clearance for processing the workpiece. The distance $D_{OE}$ can be equal to or less than about 2 inches. In some embodiments, the distance $D_{OE}$ can be equal to or less than about 1.5 inches. In some embodiments, the distance $D_{OE}$ is in the range of about 1 inch to about 3 inches. In some embodiments, the distance $D_{OE}$ is in the range of about 0.75 inch to about 2 inches. Other dimensions are also possible.

The nozzle orifice 318 of FIG. 2 has a centerline 323 near an outermost edge or surface 327 of the nozzle system 130. A length $L_1$ between the centerline 323 and the edge 327 can be minimized to increase processing flexibility. As such, a length $L_2$ from the centerline 323 to the workpiece 120 can be relatively small in order to access locations without much clearance. For increased processing flexibility, the length $L_1$ is less than about 0.5 inch (12.7 mm). In some embodiments, the length $L_1$ is less than about 0.15 inch (3.81 mm) to process relatively small features. In some embodiments, the length $L_1$ is about 0.1 inch (2.54 mm) such that the nozzle system 130 can conveniently process the corner 331 of the workpiece 102. In some embodiments, the length $L_1$ is greater than about 0.1 inch (2.54 mm) to process workpieces with more clearance. Other lengths $L_1$ are also possible. Various types of fluid components can form portions of the fluid flow conduit 217. FIG. 3A shows the downstream section 314 of the fluid flow conduit 217 including a mixing assembly 240 and a delivery conduit 250. The mixing assembly 240 of FIG. 3A is in communication with both a fluid feed assembly 220 and a media feed assembly 230. The delivery conduit 250 is positioned downstream of the mixing assembly 240 and is configured to generate the illustrated fluid jet 134.

In general, fluid flows through the fluid feed assembly 220 and into the mixing assembly 240. Media can pass through the media feed assembly 230 and into the mixing assembly 240 such that a selected amount of the media 484 is entrained in the fluid flow 485 passing through the mixing assembly 240. The fluid and entrained media then flow through the delivery conduit 250 thereby forming the fluid jet 134. The fluid feed assembly 220, media feed assembly 230, and mixing assembly 240 are disposed in the main body or housing 260 of the nozzle assembly 130.

The fluid feed assembly 220 of FIG. 3A includes a fluid inlet 270 coupled to a fluid feed line 272 of the fluid delivery system 144. As used herein, the term "inlet" is a broad term that includes, without limitation, a feature that serves as an entrance. Exemplary inlets can include, but are not limited to, connectors (either threaded or unthreaded), bores (e.g., an internally threaded bore), passageways, and other types of components suitable for receiving a flowable substance. The illustrated fluid inlet 270 is a connector having a channel 280, a mounting portion 290 temporarily or permanently coupled to the nozzle main body 260, and a coupling portion 300 temporarily or permanently coupled to the fluid feed line 272.

Figure 3B:
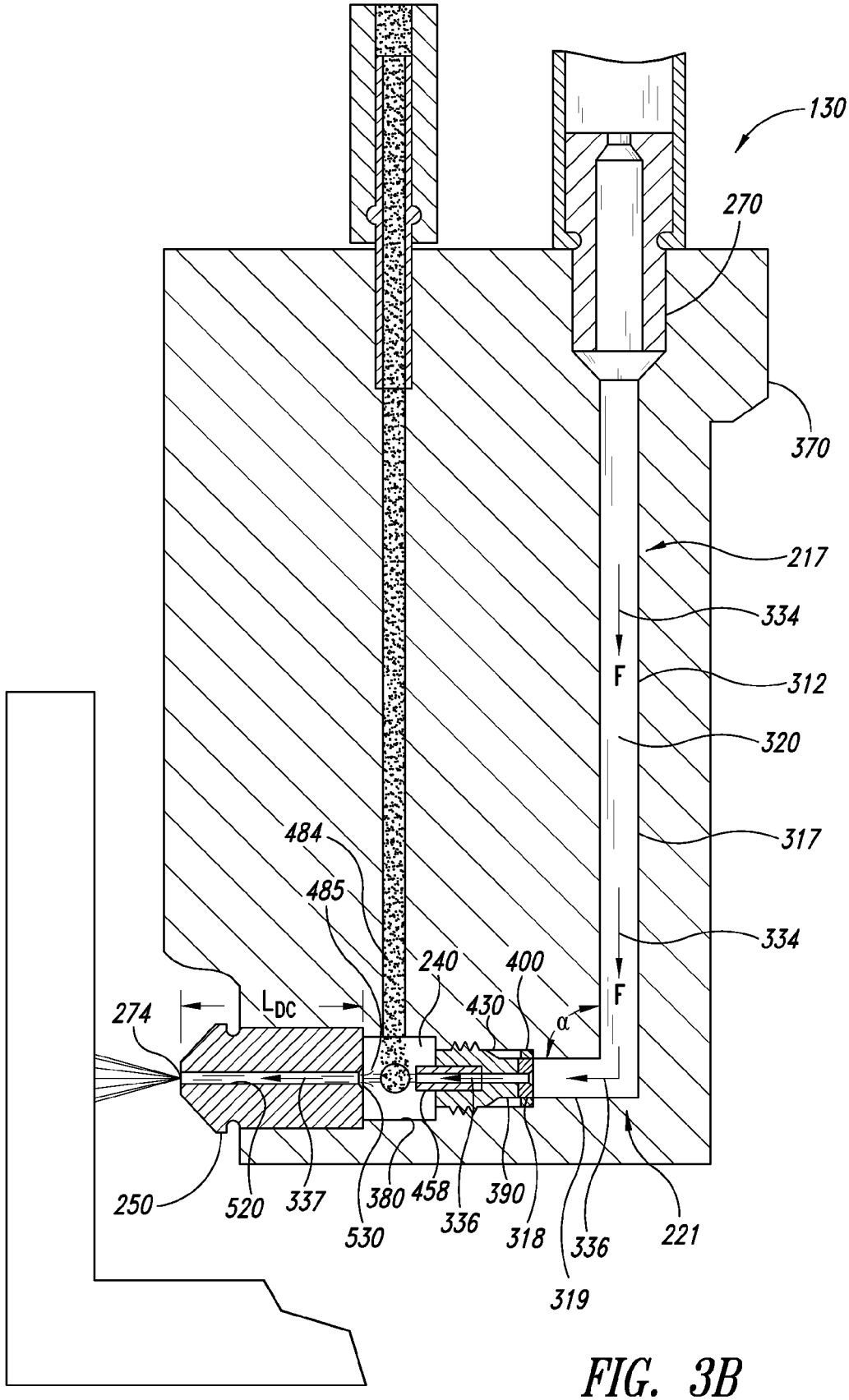
FIG. 3B is a cross-sectional view of the low-profile nozzle system of FIG. 3A.

Referring to FIGS. 3A and 3B, the upstream section 312 of the fluid flow conduit 217 includes a first section 317 extending upstream from the flow redirector 221 and a second section 319 extending downstream from the flow redirector 221. Generally, a substantial portion of the first section 317 extends primarily in a first direction (indicated by the arrows 334). The downstream second section 319 extends primarily in a second direction (indicated by the arrows 336) different than the first direction. The illustrated flow redirector 221 can guide fluid from the first section 317 to the second section 319, and thus reduce the working clearance needed to operate the nozzle system 130 in comparison to the working clearance required to operate linearly arranged conventional nozzle systems.

In some embodiments, including the illustrated embodiment of FIG. 3B, the flow redirector 221 defines an angle $\alpha$ between the first and second sections 317, 319. The illustrated angle $\alpha$ is about 90 degrees. The flow redirector can also define other angles $\alpha$ as discussed in connection with FIGS. 8 and 9. Additionally, the nozzle system 130 can have more than one flow redirector 221.

As best seen in FIG. 3B, the mixing assembly 240 includes the nozzle orifice 318 for producing a fluid jet, a mixing chamber 380, and an orifice mount 390 positioned between the nozzle orifice 318 and mixing chamber 380. The term "nozzle orifice" as used herein generally refers to, but is not limited to, a component or feature having an aperture or opening that produces a fluid jet suitable for processing a workpiece. Various types of jewels, fluid jet producing devices, or cutting stream producing devices can be used to achieve the desired flow characteristics of the fluid jet 134. In some embodiments, an orifice of the nozzle orifice 318 has a diameter in the range of about 0.001 inch (0.025 mm) to about 0.02 inch (0.5 mm). Nozzle orifices with orifices having other diameters can also be used, if needed or desired.

A sealing member 400 can form a fluid tight seal to reduce, limit, or substantially eliminate any fluid escaping to the mixing assembly 240. The illustrated sealing member 400 is a generally annular compressible member surrounding the nozzle orifice 318, thereby sealing the interface between the nozzle orifice 318 and the nozzle main body 260. Additionally, the sealing member 400 can help hold the nozzle orifice 318 in a desired position. Polymers, rubbers, metals, and combinations thereof can be used to form the sealing member 400.

Figure 4:
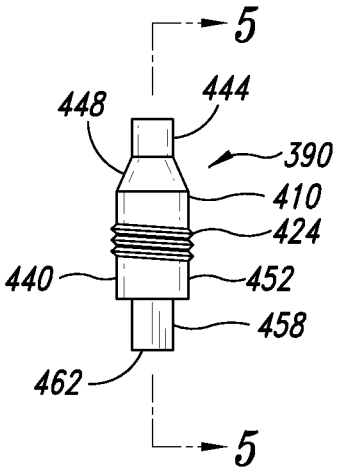
FIG. 4 is a side elevational view of an orifice mount, in accordance with one embodiment.
Figure 5:
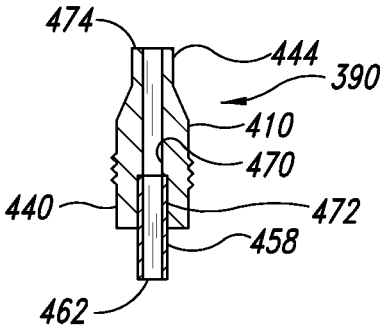
FIG. 5 is a cross-sectional view of the orifice mount of FIG. 4 taken along the line 5-5 of FIG. 4.

The nozzle system 130 can employ various types of orifice mounts. FIGS. 4 and 5 show the orifice mount 390 including a mount main body 410 and a guide tube 458 protruding outwardly from the mount main body 410. The guide tube 458 can be temporarily or permanently coupled to the mount main body 410. For example, a press fit, interference fit, or shrink fit can be used to couple the guide tube 458 to the mount main body 410.

FIGS. 3A and 4 show the mount main body 410 including engagement features 424 for engaging complementary features 426 of the nozzle main body 260. The illustrated engagement features 424 are in the form of external threads that mate with internal threads 426. The engagement features 424, 426 cooperate to limit or substantially prevent axial movement of the mount main body 410 with respect to the nozzle main body 260, even when an ultra high-pressure fluid flow passes through the mixing assembly 240.

To remove and replace the nozzle orifice 318, the orifice mount 390 can be conveniently twisted to move it axially out of a receiving cavity 430 of the nozzle main body 260. After the nozzle orifice 318 is removed, another nozzle orifice can be installed. The nozzle orifice 318 can thus be replaced any number of times during the working life of the nozzle system 130.

With continued reference to FIGS. 4 and 5, the mount main body 410 includes an enlarged portion 440 for engaging the nozzle main body 260, a seating portion 444 for holding the nozzle orifice 318 in a desired position, and a tapered portion 448 extending between the enlarged portion 440 and the seating portion 444. The enlarged portion 440 has an outer perimeter that is greater than the outer perimeter of the seating portion 444. The tapered portion 448 has an outer perimeter that gradually decreases between the enlarged portion 440 and the seating portion 444. As shown in FIG. 3A, the enlarged portion 440 can bear against an inner surface of the nozzle main body 260. The seating portion 444 can press the nozzle orifice 318 against the nozzle main body 260 to limit or substantially eliminate unwanted movement of the nozzle orifice 318.

Referring to FIG. 5, the mount main body 410 and the guide tube 458 cooperate to define a channel 470. The channel 470 extends between a seating face 474 of the seating portion 444 and a downstream end 462 of the tube 458. The mount main body 410 can have a stepped region 472 for receiving the tube 458.

The tube 458 can help guide fluid flow through the mixing assembly 240. For example, as shown in FIGS. 3A and 3B, the tube 458 protrudes into and directs the flow of fluid 485 through the mixing chamber 380. The downstream end 462 of the tube 458 can be positioned upstream, within, or downstream of the media flow 484 being introduced to the fluid flow 485, depending on the desired interaction of the media flow 484 and fluid flow 485.

The tube 458 can be formed of different materials suitable for contacting different types of flows. For improved wear characteristics, the tube 458 can be made, in whole or in part, of a hardened material that can be repeatedly exposed to the fluid jet exiting the nozzle orifice 318. The hardened material can be harder than the material (e.g., steel) forming the mount main body 410 in order to keep damage to the tube 458 below or at an acceptable level. The tube 458, for example, can erode less than traditional materials used to form orifice mounts and, consequently, can retain its original shape even after extended use. The softer mount main body 410 can limit damage to the nozzle main body 260.

Hardened materials may include, without limitation, tungsten carbide, titanium carbide, and other abrasion resistant or high wear materials that can withstand exposure to fluid jets. Various types of testing methods (e.g., the Rockwell hardness test or Brinell hardness test) can be used to determine the hardness of a material. In some non-limiting exemplary embodiments, the tube 458 is made, in whole or in part, of a material having a hardness that is greater than about 3 $R_C$ (Rockwell, Scale C), 5 $R_C$, 10 $R_C$, or 20 $R_C$ of the hardness of the mount main body 410 and/or the nozzle main body 260. The tube 458 can be made, in whole or in part, of a material having a hardness greater than about 62 $R_C$, 64 $R_C$, 66 $R_C$, 67 $R_C$, and 69 $R_C$, or ranges encompassing such hardness values. In some embodiments, the orifice mount 390 can be formed, in whole or in part, of a durable material (e.g., one or more metals with desirable fatigue properties, such as toughness) and the tube 458 can be formed, in whole or in part, of a high wear material. In some embodiments, for example, the orifice mount 390 is formed of steel and the tube 458 is formed of tungsten carbide.

Figure 6:
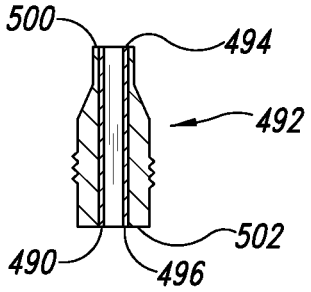
FIG. 6 is a cross-sectional view of an orifice mount, in accordance with one embodiment.
Figure 7:
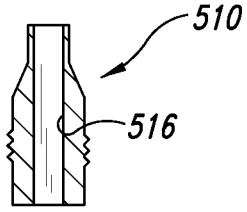
FIG. 7 is a cross-sectional view of an orifice mount, in accordance with one embodiment.

FIG. 6 shows an orifice mount 492 with a completely buried tube 490. An upstream end 494 and a downstream end 496 of the tube 490 are proximate or flush with respective faces 500, 502 of the orifice mount 492. FIG. 7 shows an orifice mount 510 without a separate tube. A coating 516 can be applied to an inner surface of a throughole the orifice mount 510. The coating 516 can comprise a hardened material, or other suitable high wear materials.

Referring again to FIG. 3B, the delivery conduit 250 includes the outlet 274, an inlet 530, and a channel 520 extending between the outlet 274 and the inlet 530. The media 484 can be combined with the fluid jet in the mixing chamber 380 to form an abrasive fluid jet 337 that proceeds into and through the channel 520. The abrasive fluid jet 337 proceeds along the channel 520 and is ultimately delivered from the outlet 274 as the fluid jet 134.

The delivery conduit 250 can be a mixing tube, focusing tube, or other type of conduit configured to produce a desired flow (e.g., a coherent flow in the form of a round jet, fan jet, etc.). The delivery conduit 250 can have an axial length $L_{DC}$ that is equal to or less than about 2 inches (5.1 cm). In some embodiments, the length $L_{DC}$ is in the range of about 0.5 inch (1.3 cm) to about 2 inches (5.1 cm). In some embodiments, the length $L_{DC}$ can be equal to or less than about 1 inch (2.5 cm). The average diameter of the channel 520 can be equal to or less than about 0.05 inch (1.3 mm). In some embodiments, the average diameter of the channel 520 is in the range of about 0.002 inch (0.05 mm) to about 0.05 inch (1.3 mm). The length $L_{DC}$, diameter of the channel 520, and other design parameters can be selected to achieve the desired mixing action of the fluid mixture passing therethrough. In some embodiments, a ratio of the length $L_{DC}$ to the average diameter of the channel 520 is equal to or less than about 25, 20, or 15, or ranges encompassing such ratios. In some embodiments, the ratio of the length $L_{DC}$ to the average diameter of the channel 520 is in the range of about 15 to about 25.

The relatively small distance between the outlet 274 and the nozzle orifice 318 can help reduce the size of the nozzle system 130. In some embodiments, the distance from the outlet 274 to the nozzle orifice 318 is in the range of about 0.5 inch (1.3 cm) to about 3 inches (7.6 cm). Such embodiments permit enhanced mixing of abrasives, if any, and the high pressure feed fluid F. In some embodiments, the distance from the outlet 274 to the nozzle orifice 318 is in the range of about 0.25 inch (0.64 cm) to about 2 inches (5.1 cm). In such embodiments, the dimension $D_C$ of the nozzle system 130 (see FIG. 1) can be less than about 4 inches, 5 inches, or 6 inches, thereby permitting the nozzle system 130 to be passed through relatively small spaces.

Referring again to FIG. 3A, the media feed line 170 is in fluid communication with the media inlet 200 of the media feed assembly 230. The media inlet 200 defines a channel 540 for media flow therethrough. A mounting portion 546 of the media inlet 200 is temporarily or permanently coupled to the nozzle main body 260. A coupling portion 550 of the media inlet 200 is temporarily or permanently coupled to the media feed line 170. A media delivery conduit 558 defining a media passageway 560 extends between the media inlet 200 and mixing assembly 240. The illustrated media delivery conduit 558 is generally parallel to the fluid flow conduit 217, although this is not required. In some embodiments, the media delivery conduit 558 can be positioned on a different plane than the fluid flow conduit 217.

The media feed assembly 230 further includes a media outlet 570 positioned upstream of the delivery conduit 250 and downstream of the orifice mount 390 with respect to the fluid flowing from the nozzle orifice 318. Media 484 from the media outlet 570 may combine with the fluid flow from the orifice mount 390 to form the abrasive fluid entering the delivery conduit 250.

Figure 9:
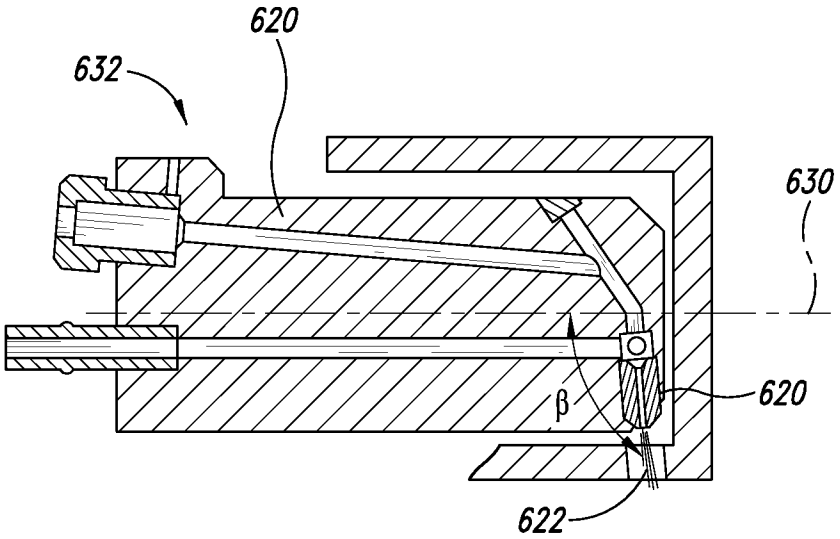
FIG. 9 is a cross-sectional view of a nozzle system generating a laterally directed fluid jet processing a workpiece, in accordance with another embodiment.
Figure 8:
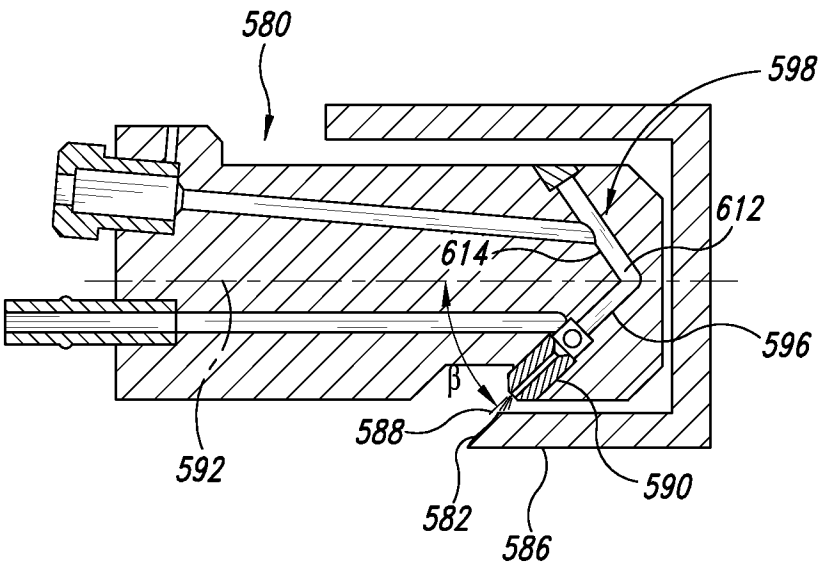
FIG. 8 is a cross-sectional view of a nozzle system generating a laterally directed fluid jet processing a workpiece, in accordance with one embodiment.

FIGS. 8 and 9 show horizontally oriented nozzle systems that can be generally similar to the nozzle system 130 of FIG. 1. A nozzle system 580 of FIG. 8 is processing a bevel 582 of a workpiece 586. A delivery conduit 590 of the nozzle system 580 delivers a fluid jet 588 at an acute angle β. (illustrated as about 45 degrees) with respect to a longitudinal axis 592 of the nozzle system 580. Other angles are also possible. For example, FIG. 9 shows a nozzle system 632 including a delivery conduit 620 delivering a fluid jet 622 at an obtuse angle β (illustrated as about 100 degrees) with respect to a longitudinal axis 630 of the nozzle system 632. The angle β can be selected based on the processing criteria related to the process to be performed. Other angles (e.g., angles orthogonal to a second non-linear section 614) are also possible.

The nozzle system 580 of FIG. 8 further includes a fluid delivery conduit 598 having a flow redirector 596 that is somewhat V-shaped (as viewed from the side). The illustrated flow redirector 596 includes a first non-linear section 612 and the second non-linear section 614 connected to the first angled section 612. The illustrated non-linear sections 612, 614 are angled sections, and because each of the angled sections 612, 614 defines an obtuse angle, fluid can flow through the flow redirector 596 without causing significant damage to inner surfaces of the flow redirector 596.

The nozzle system 580 can generate the fluid jet 588 with a relatively high flow rate, even if the fluid jet 588 is at a relatively small acute angle β to process angled surfaces, such as the bevel 582 of FIG. 8. The nozzle system 580 can access locations with relatively small amounts of clearance to process angled surfaces. The number and configuration of non-linear sections of the flow redirector 596 can be selected based on operating parameters, such as desired flow rate, size of the nozzle system 580, and orientation and position of the fluid jet 588, as well as other parameters that may affect the speed and quality of processing.

Figure 10:
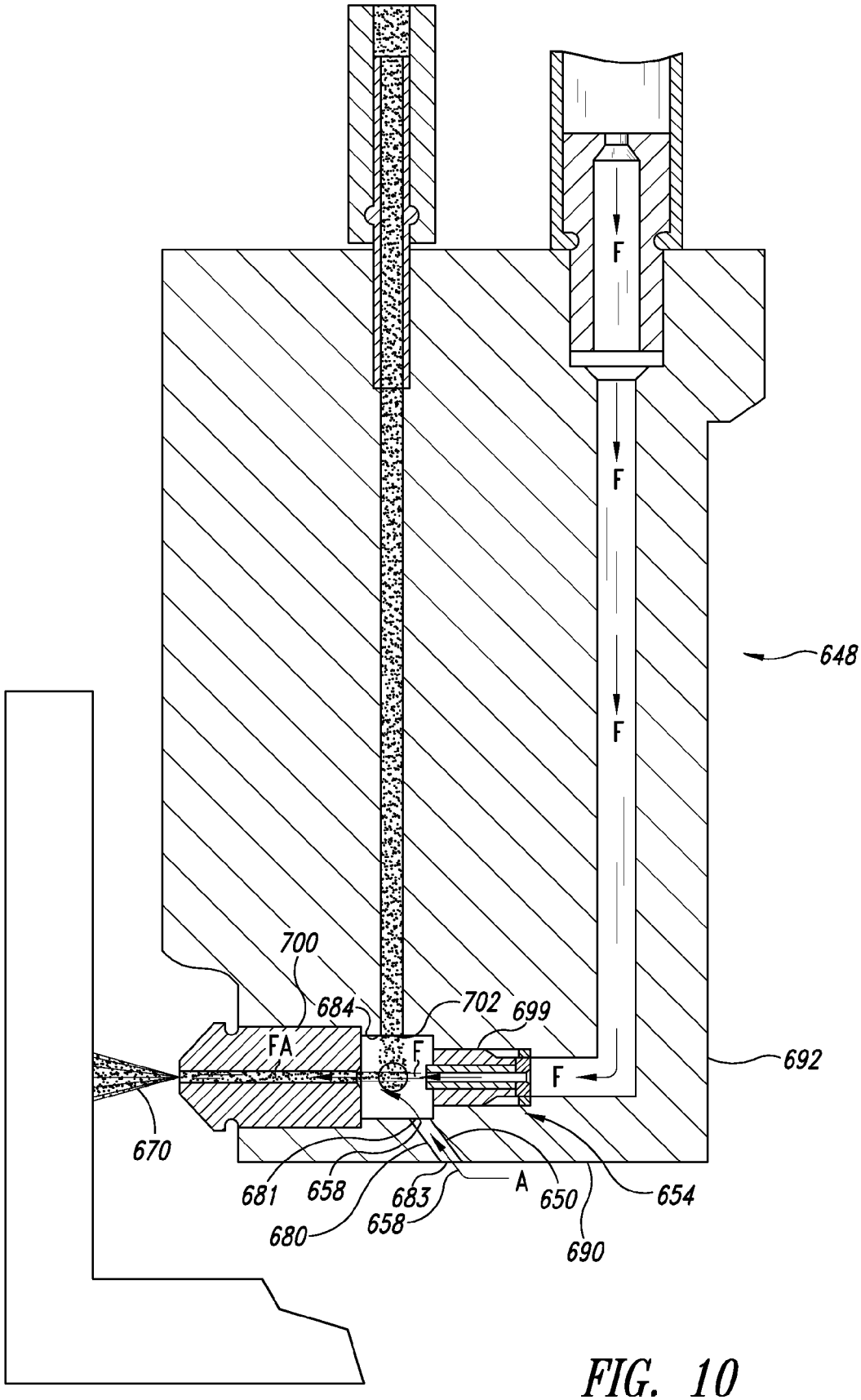
FIG. 10 is a cross-sectional view of a nozzle system with a secondary port for a mixing chamber, in accordance with one embodiment.

FIG. 10 shows a nozzle system 648 including a secondary port 650 for delivering fluid A (indicated by the arrows 658) into a mixing device 654. The flow of fluid A, such as air, can be used to adjust one or more flow criteria of the fluid jet 670. The illustrated secondary port 650 extends between an outlet 681 positioned along a mixing chamber 684 and an inlet 683 positioned along the outermost surface 690 of a nozzle main body 692. Air passing through the secondary port 650 can help prevent media from impacting the downstream section of the orifice mount 699 and may therefore reduce wear of the orifice mount 699. An air cushion can be formed within the mixing chamber 684. For example, a stream of airflow can form an air cushion extending between the outlet 681 and a delivery conduit 700 to reduce or limit damage (e.g., wear or erosion) to the mixing chamber 684, especially the surface opposite a media inlet 702. The stream of airflow A can direct media, fluid F, or other matter in the mixing chamber 684 into and through the delivery conduit 700. Even if media (or other matter) strikes the surfaces of the mixing chamber 684, the stream of airflow A can serve as an air cushion that reduces the impact velocity of the media to reduce or limit damage to the surfaces of the mixing chamber 684. The media, fluid F, and air A can therefore merge together in the mixing chamber 684 while keeping damage to the nozzle system 648 at or below an acceptable level.

Figure 11:
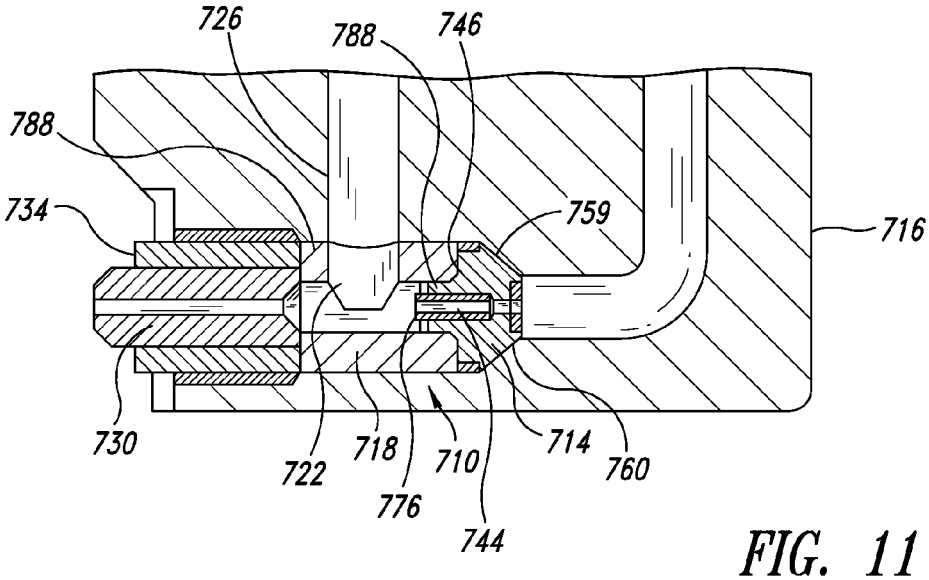
FIGS. 11-13 are cross-sectional views of portions of nozzle systems, in accordance with some embodiments.
Figure 12:
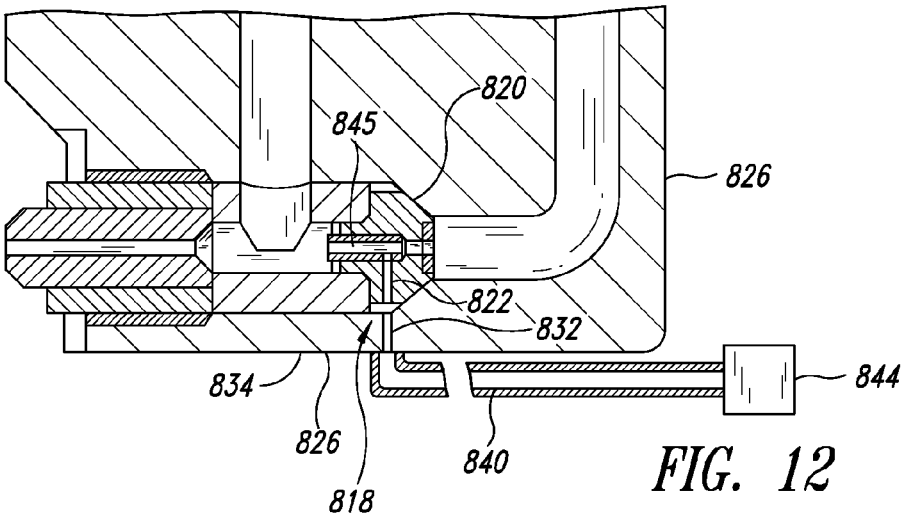
Figure 13:
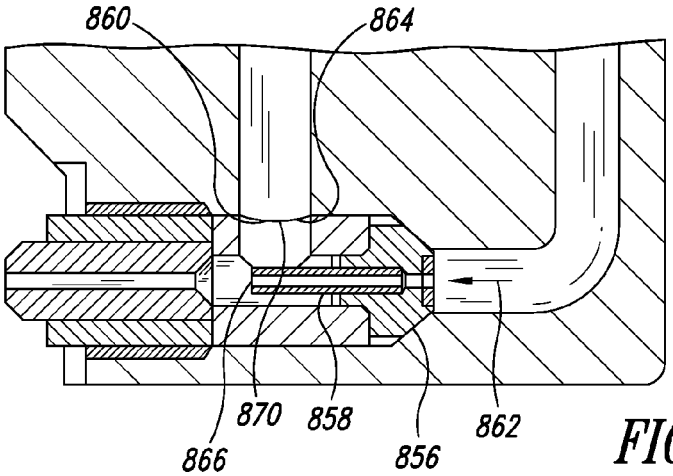

FIGS. 11-13 illustrate mixing devices that may be generally similar to each other and, accordingly, the following description of one of the mixing devices applies equally to the other, unless indicated otherwise. FIG. 11 shows a mixing device 710 including an orifice mount 714 sandwiched between a nozzle main body 716 and a manifold 718 having a manifold inlet 722 for receiving media from a media feed conduit 726. A sealing surface 759 forms a fluid tight seal between the orifice mount 714 and nozzle main body 716. A delivery conduit 730 is coupled to the nozzle main body 716 via a coupler 734.

The orifice mount 714 includes a tapered sealing portion 760 (illustrated as an approximately frusto-conical surface) for contacting the nozzle main body 716, a guide tube 744, and an enlarged body 746 generally between the seating portion 760 and the guide tube 744. Because the manifold 718 axially retains the orifice mount 714, the axial length of the orifice mount 714 of FIG. 11 can be smaller than the axial length of the orifice mount 390 of FIGS. 3A and 3B. The orifice mount 714 of FIG. 11 can have a smaller axial length because it does not need to accommodate external threads or other coupling features.

The illustrated seating portion 760 of the orifice mount 714 and a complementary surface 759 of the nozzle main body 716 are both generally frusto-conical to facilitate self-centering of the orifice mount 714. Additionally, when the orifice mount 714 is pressed against the surface 759, a seal 760 can be formed. Various types of materials can be used to form the seating portion 760 and the surface 759 of the orifice mount 714. One or more metals can be used to form at least a portion of the seating portion 760 and the surface 759 in order to form the desired seal 760.

Because the manifold 718 presses the orifice mount 714 against the nozzle main body 716, the manifold 718 can experience significant compressive forces. The orifice mount 714 or manifold 718 or both can experience significant compressive loads without appreciable damage via, for example, cracking (e.g., micro-cracking), buckling, plastic deformation, and other failure modes. Suitable materials for forming, in whole or in part, the orifice mount 714 and/or manifold 718 include, without limitation, metals (e.g., steel, aluminum, and the like), ceramics, and other materials selected based on fracture toughness, wear characteristics, yield strength, and the like. For example, the orifice mount 714 is made of steel and the manifold 718 is made of ceramic.

The coupler 734 can securely couple the delivery conduit 730 in the nozzle main body 716. The coupler 734 can have engagement features (e.g., external threads) that mate with complementary engagement features (e.g., internal threads)

of the nozzle main body 716. The coupler 734 can be conveniently moved axially through the nozzle main body 716 until it presses against the manifold 718, which in turn presses against the orifice mount 714.

An interference fit, press fit, shrink fit, or other type of fit can be used to limit or substantially eliminate unwanted movement of the delivery conduit 730 with respect to the coupler 734. Other coupling means can also be used. For example, one or more adhesives, welds, fasteners (e.g., set-screws), or set of complementary threads can be used. An adhesive in some embodiments can be applied between an outer surface of the delivery conduit 730 and an interior surface of the coupler 734.

Venting of orifice mounts can be used to adjust jet coherency, as well as other flow criteria. For example, venting can create a higher pressure area at the upstream end of the orifice flow passage 744 than the pressure in the mixing chamber area, and accordingly, the media coming through the orifice flow passage 744 does not travel upstream. FIG. 12 shows a secondary port 818 extending through an orifice mount 820 and a nozzle main body 826. The secondary port 818 includes an inner secondary port 822 and an outer secondary port 832. The inner secondary port 822 extends between a gap between the orifice mount 820 and the nozzle main body 826 and a channel 845. The outer secondary port 832 extends between the gap and the outer surface 834 of the nozzle main body 826.

In some embodiments, including the illustrated embodiment of FIG. 12, a secondary feed line 840 is in communication with the outer secondary port 832 and a secondary fluid source 844. The secondary fluid source 844, in some embodiments, pressurizes a substance (e.g., a fluid, media, and the like) that is delivered at a selected flow rate into the orifice mount 820 via the secondary port 818 in order to adjust one or more flow criteria, such as the dispersion of the fluid jet, coherency of the fluid jet, and other flow criteria that effect the performance of the fluid jet, as well as the ratio of constituents of the fluid jet. The secondary fluid source 844 can include a pump (e.g., a low pressure pump) or other types of pressurizing devices.

Alternatively, the outer secondary port 832 can be exposed to the surrounding environment. Air drawn from the surrounding environment through the secondary port 818 can mix with the fluid jet passing through the channel 845 of the orifice mount 820.

FIG. 13 shows an orifice mount 856 having a downstream end 866 positioned to engage a media flow. The orifice mount 856 includes a guide tube 858 extending downstream of at least a portion of a manifold media inlet 860 with respect to the direction of the primary fluid flow (indicated by the arrow 862). The illustrated downstream end 866 of the tube 858 is positioned downstream, with respect to the direction of the primary fluid flow, of the manifold media inlet 860. Abrasive media passing through the manifold media inlet 860 may strike and flow around the tube 858 and then mix with the primary fluid flowing out of the tube 858.

Figure 14:
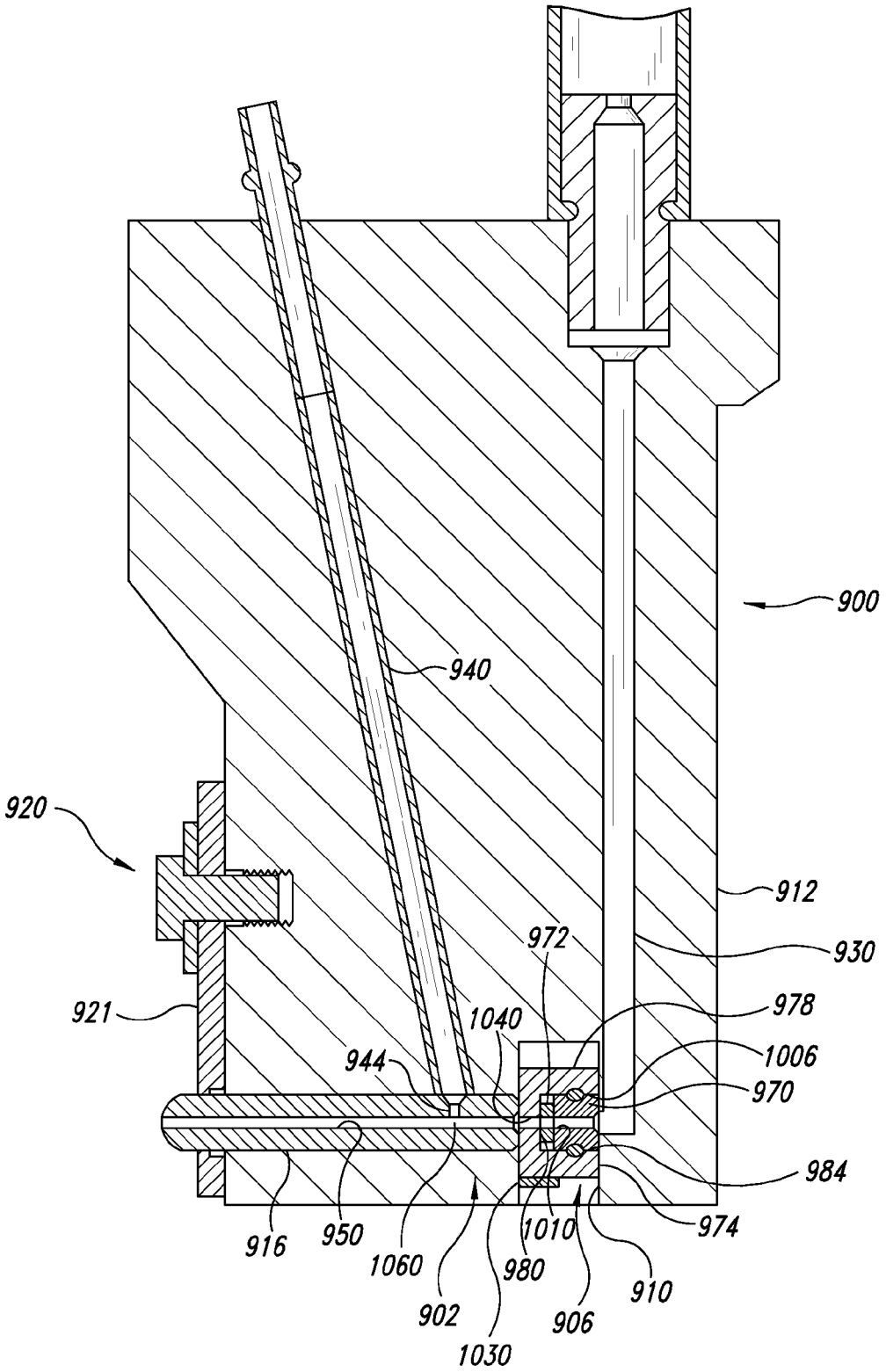
FIG. 14 is a cross-sectional view of a nozzle system having a removable orifice assembly, in accordance with one embodiment.

FIG. 14 illustrates a nozzle system 900 without a mixing chamber so as to further reduce the size of the nozzle system 900. The nozzle system 900 includes a mixing device 902 with one or more removable components. The components of the mixing device 902 can be removed in order to perform maintenance (e.g., either on the component or on the nozzle system itself), replace the component, and/or perform inspections.

The mixing device 902 of FIG. 14 includes a removable orifice assembly 906 in a receiving slot 910 of a nozzle main body 912 (see FIG. 15) and a slender delivery conduit 916. If needed or desired, the entire orifice assembly 906 can be conveniently removed from the nozzle system 900 for disassembling, as shown in FIG. 16.

Figure 16:
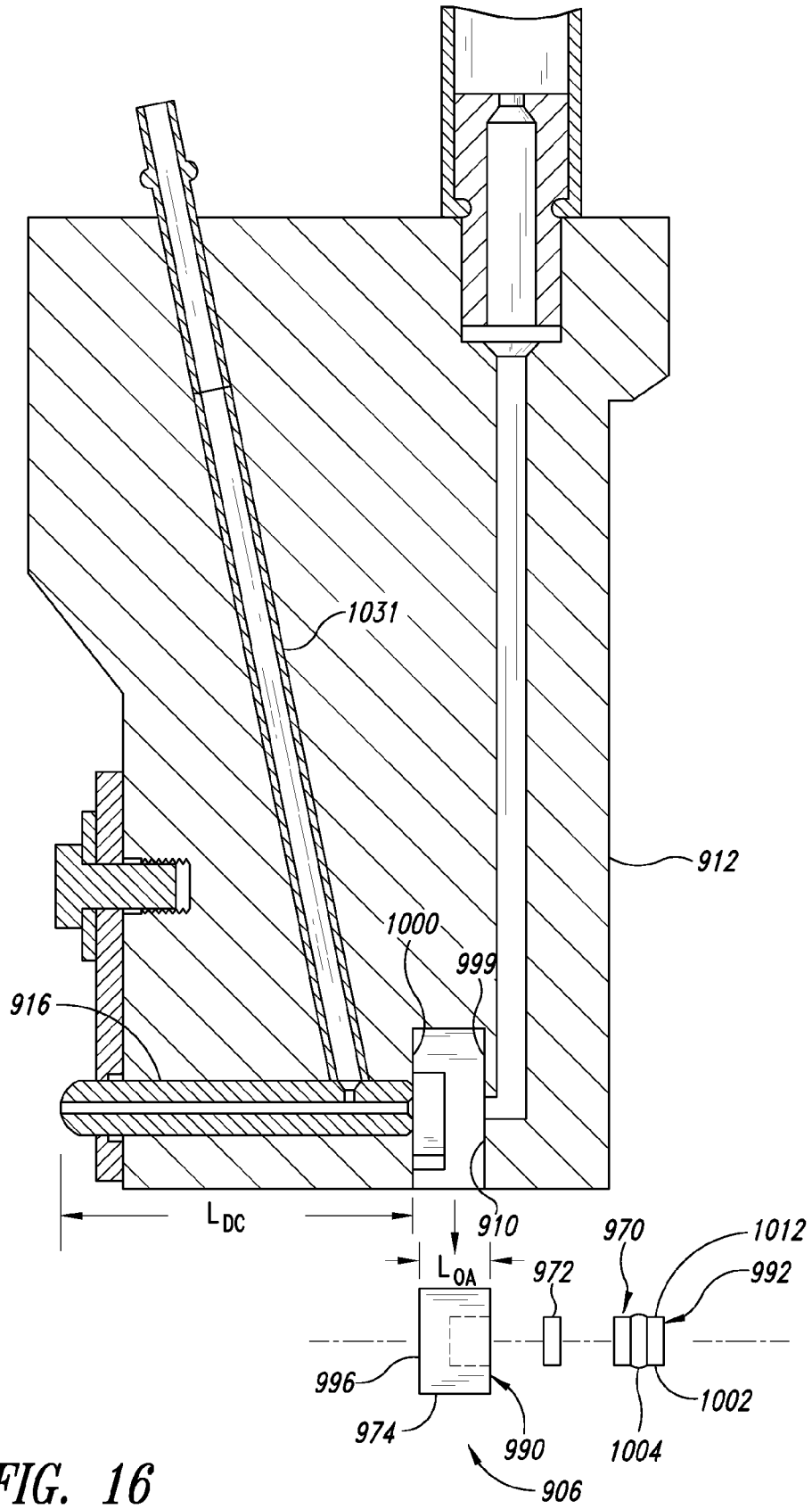
FIG. 16 is a cross-sectional view of a nozzle main body and an exploded view of an orifice assembly removed from the nozzle main body.

Referring to FIGS. 14 and 16, the orifice assembly 906 includes a face seal 970, a nozzle orifice 972, and an orifice mount 974 having a receiving section 978. The receiving section 978 surrounds and retains both the face seal 970 and nozzle orifice 972. FIG. 14 shows the nozzle orifice 972 between the face seal 970 and a back wall 980 of the orifice mount 974. A cylindrical sidewall 984 of the receiving section 978 can closely receive and maintain proper alignment of both the nozzle orifice 972 and face seal 970.

With respect to FIG. 16, a front face 990 of the orifice mount 974 and a front surface 992 of the face seal 970 can be generally flush so that the orifice assembly 906 can be slid into and out of the receiving slot 910 without appreciable interference between the face seal 970 and the nozzle main body 912. In the illustrated embodiment, the front face 990 and a rear face 996 of the orifice mount 974 can slide smoothly against a corresponding front surface 999 and a rear surface 1000 of the receiving slot 910.

The face seal 970 of FIG. 16 includes a main body 1002 and a sealing member 1004 disposed in a groove 1006 (FIG. 14) extending circumferentially about the main body 1002. The main body 1002 defines a central bore 1010 and includes an outer surface 1012 (FIG. 16) dimensioned to fit closely within the receiving section 978 of the orifice mount 974.

The sealing member 1004 of FIG. 16 can be an O-ring, annular compressible member, or other type of component capable of forming a fluid tight interface between the face seal 970 and the orifice mount 974. The illustrated groove 1006 and sealing member 1004 are positioned generally midway along the axial length of the sealing member 1004. The groove 1006 and sealing member 1004 can also be at other locations, and other types of sealing arrangements can be used.

Figure 15:
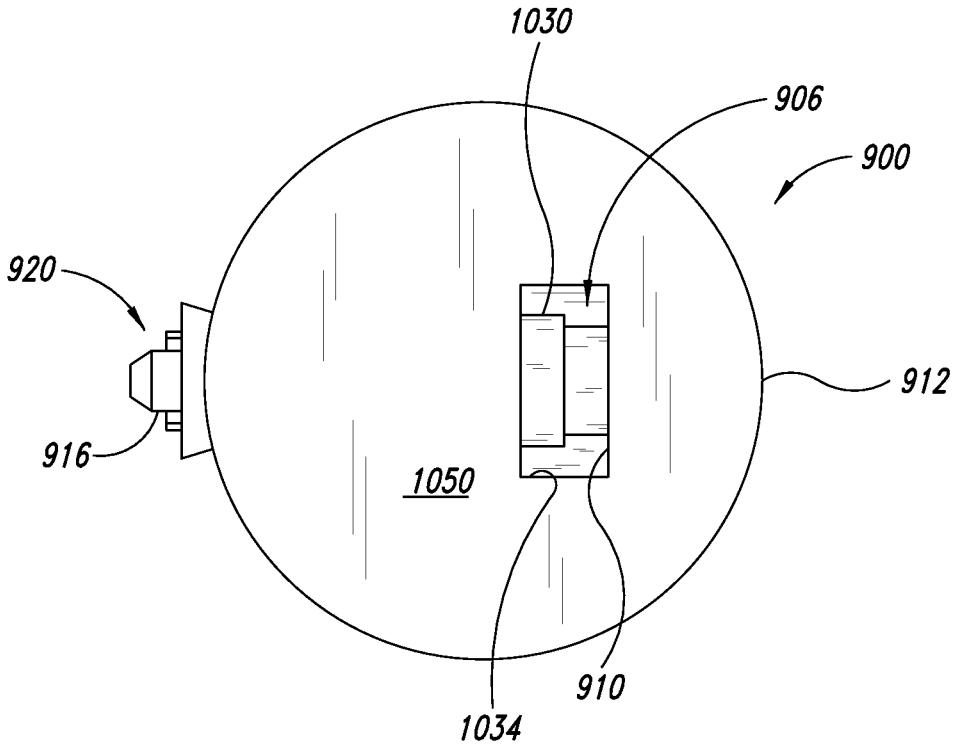
FIG. 15 is a bottom view of the nozzle system of FIG. 14.

Various types of retaining means may be employed to retain the mixing devices in desired positions in the nozzle main body. FIGS. 14 and 15 show a retaining member 1030 surrounding a portion of the orifice assembly 906. The retaining member 1030 is fixedly coupled to an inner surface 1034 of the slot 910 and can tightly hold the orifice assembly 906 to maintain proper alignment of the channels 1010, 1040, 950. Additionally or alternatively, one or more retaining clips, clamps, pins, fasteners, or brackets can be used to hold one or more components of the nozzle system 900, if needed or desired.

An external mounting assembly 920 for retaining the delivery conduit 916 is coupled to the nozzle main body 912. The external mounting assembly 920 includes a protective plate 921 that can be pressed against and cover a section of the nozzle main body 912. The protective plate 921 can be a generally planar sheet made of a hardened material suitable for protecting the nozzle main body 912, even if the protective plate 921 strikes the workpiece. The delivery conduit 916 of FIG. 14 is configured to combine a primary fluid flow and a secondary media flow. The delivery conduit 916 includes a secondary port 944 positioned along the channel 950. A media flow conduit 940 includes an inner surface formed of a hardened material. The illustrated media flow conduit 940 is a tubular member capable of resisting abrasive wear and positioned in the nozzle main body 912. The media flow passing through the secondary port 944 and the primary fluid flow from the orifice assembly 906 can be combined at a mixing section 1060 of the channel 950.

As shown in FIG. 16, the longitudinal length $L_{DC}$ of the delivery conduit 916 can be relatively large because of the short length of the orifice assembly 906. Because the delivery conduit 250 defines a mixing chamber, the longitudinal length $L_{DC}$ of the delivery conduit 916 can be increased to achieve the desired amount of mixing. A length $L_{OA}$ of the orifice assembly 906 can be relatively small because it does not have external threads. In some embodiments, the length $L_{OA}$ of the orifice assembly 906 is in the range of about 0.1 inch (2.5 mm) to about 0.5 inch (12.7 mm). In some embodiments, the length $L_{OA}$ of the orifice assembly 906 is about 0.2 inches (5.1 mm). In some embodiments, the longitudinal length $L_{DC}$ of the delivery conduit 916 is in the range of about 0.5 inch (12.7 mm) to about 3 inches (76.2 mm). Such delivery conduits 916 are well suited for receiving a wide range of medias and producing highly focused coherent abrasive water jets. In some embodiments, the longitudinal length $L_{DC}$ is in the range of about 1 inch (25.4 mm) to about 3 inches (76.2 mm). If the delivery conduit 916 becomes damaged, the mounting assembly 920 can be operated to release and remove the damaged delivery conduit 916.

Figure 17:
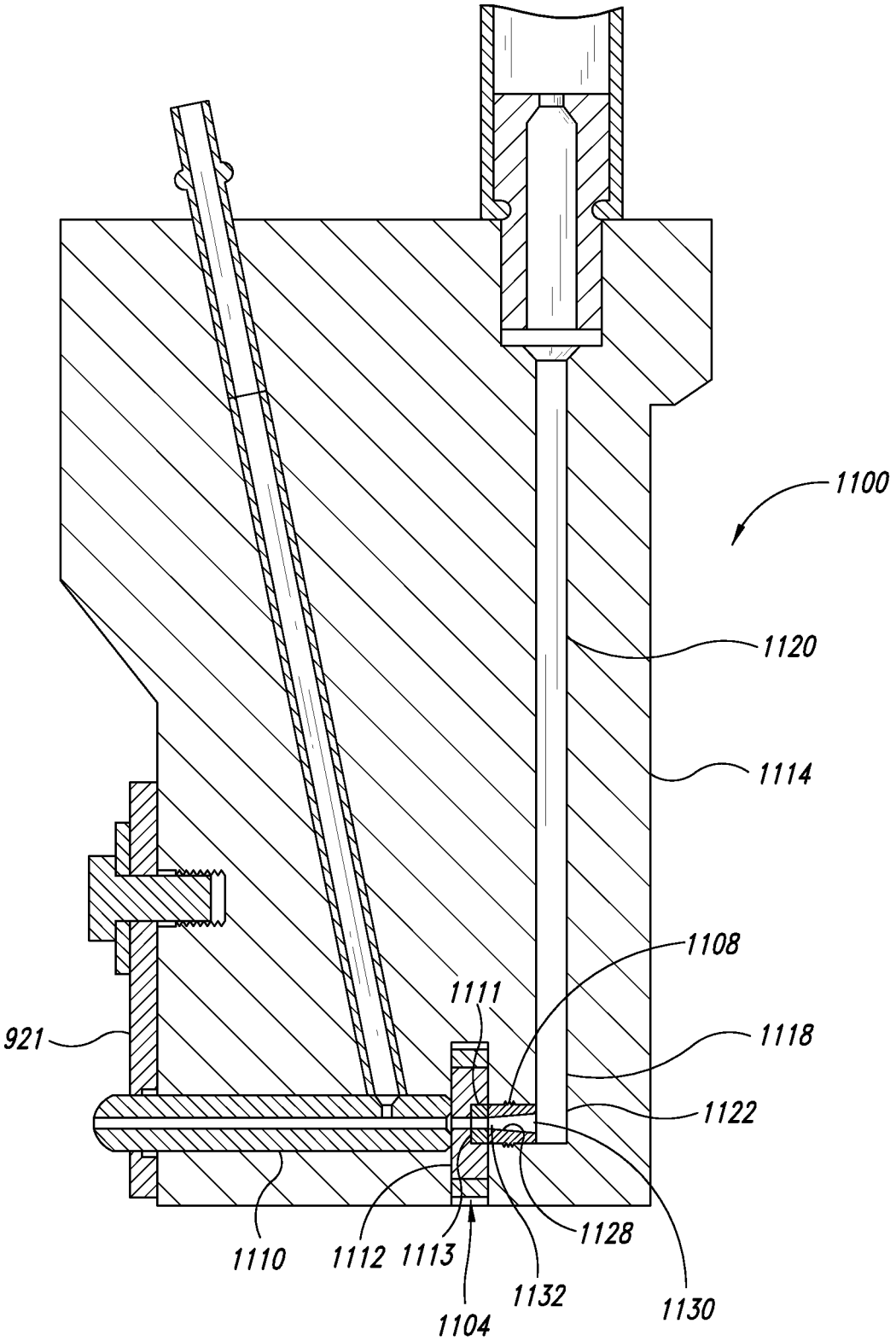
FIG. 17 is a cross-sectional view of a nozzle system having a removable orifice assembly, in accordance with one embodiment.

FIG. 17 shows a nozzle assembly 1100 that may be generally similar to the nozzle assembly 900 of FIG. 16. In general, the nozzle assembly 1100 includes an orifice assembly 1104 interposed between a face seal 1108 and a delivery conduit 1110. The orifice assembly 1104 includes a thin disk-shaped orifice mount 1112 to further reduce the size of the nozzle assembly 1100. A nozzle orifice 1111 is positioned in a centrally disposed recess 1113 of the orifice mount 1112. The nozzle assembly 1100 further includes a nozzle main body 1114 in which the face seal 1108 is positioned at a downstream end 1118 of the fluid feed conduit 1120. The face seal 1108 and downstream end 1118 of the fluid feed conduit 1120 cooperate to form an angled flow redirector 1122.

The face seal 1108 is dimensioned to fit within a receiving bore 1124 of the main body 1114 and includes a flow passageway 1128 with a varying axial cross-sectional area in order to accelerate the fluid flow. In the illustrated embodiment of FIG. 17, the passageway 1128 of the face seal 1108 tapers inwardly from an entrance aperture 1130 to an exit aperture 1132. The face seal 1108 can be made, in whole or in part, of a metal, polymers, plastic, rubber, and other materials suitable contacting the mounting orifice 1112 and through which the primary fluid flows.

Figure 18:
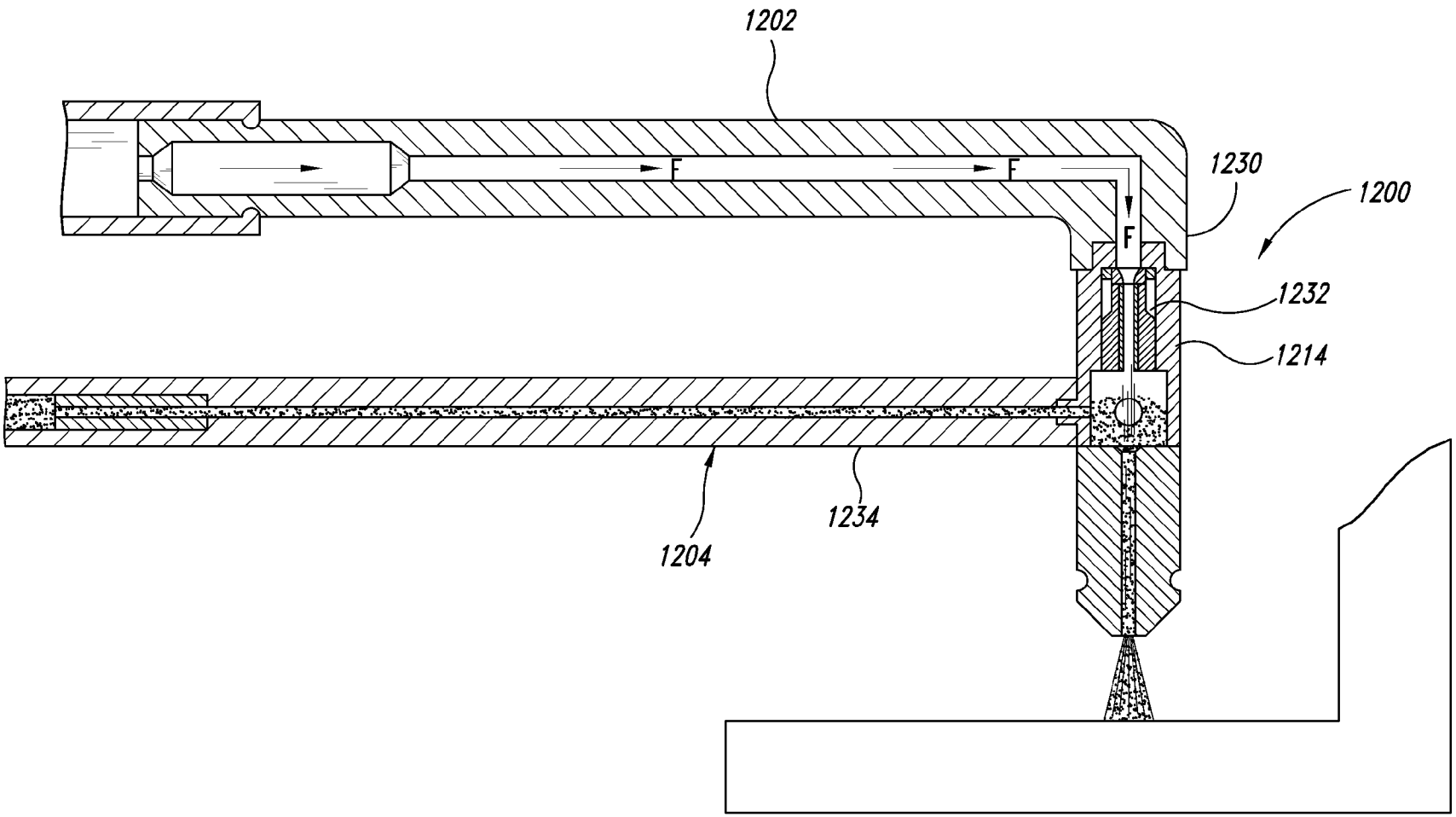
FIG. 18 is a cross-sectional view of a modular nozzle system, in accordance with one embodiment.

FIG. 18 illustrates a nozzle system 1200 with a modular fluid feed assembly 1202 and a modular media feed assembly 1204. The fluid feed assembly 1202 includes a fluid flow conduit 1230 that can be removably coupled to a main body 1214 of the nozzle system 1200. Similarly, the modular media feed assembly 1204 can include a media flow conduit 1234 that can be removably coupled to the main body 1214. In alternative embodiments, the fluid flow conduit 1230 and the media flow conduit 1234 can be permanently coupled to the main body 1214 of the nozzle system 1200.

As noted above, the fluid delivery systems and nozzle systems discussed herein can be used in numerous applications. Additionally, all of the above U.S. patents, U.S. patent application publications, U.S. patent applications, foreign patents, foreign patent applications and non-patent publications referred to in this specification and/or listed in the Application Data Sheet, U.S. Pat. Nos. 6,000,308 and 5,512,318 are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A nozzle system configured to generate a high-pressure abrasive media fluid jet, the nozzle system comprising:

a nozzle main body including a fluid feed conduit and a media feed conduit extending therethrough, the fluid feed conduit comprising a first section, a second section, and a flow redirector between the first section and the second section which is configured to receive a fluid flow traveling in a first direction through the first section and to direct the fluid flow in a second direction angled with respect to the first direction, and the media feed conduit being configured to deliver abrasives into a fluid jet so as to form a high-pressure abrasive media fluid jet;

a nozzle orifice component positioned downstream of the flow redirector, the nozzle orifice component including an aperture that is configured to generate the fluid jet;

a delivery conduit positioned downstream of the nozzle orifice component, the delivery conduit including an outlet through which the high-pressure abrasive media fluid jet exits the nozzle system; and an orifice mount positioned between the nozzle orifice component and the outlet, the orifice mount comprising a main body and a guide tube coupled to the main body, the main body being in contact with the nozzle orifice component and the guide tube defining at least a portion of a channel through which the fluid jet passes and comprising a material that is harder than a material of the main body.

2. The nozzle system of claim 1, wherein the outlet of the delivery conduit and the nozzle orifice component are separated by a distance equal to or less than about 2 inches.

3. The nozzle system of claim 2, wherein the distance is equal to or less than about 1.5 inches.

4. The nozzle system of claim 1, wherein the delivery conduit is a mixing tube defining the outlet of the nozzle system and comprising a channel, and wherein a ratio of an axial length of the mixing tube to an average diameter of the channel is less than about 100.

5. The nozzle system of claim 1, wherein the nozzle orifice component defines a centerline, and a distance between the centerline of the nozzle orifice component and an outer edge of an end of the nozzle main body of the nozzle system is equal to or less than about 0.5 inch.

6. The nozzle system of claim 1, wherein the delivery conduit comprises a channel through which the fluid jet passes and a secondary port extending from the channel to the media feed conduit.

7. The nozzle system of claim 1, wherein the nozzle orifice component is removably received in the nozzle main body via a passage in the nozzle main body that extends to an exterior surface of the nozzle system.

8. The nozzle system of claim 1, further comprising:

a coupler that removably secures the delivery conduit to the nozzle main body.

9. The nozzle system of claim 8, wherein the orifice mount is held in position downstream of the flow redirector of the fluid feed conduit of the nozzle main body by the coupler.

10. The nozzle system of claim 8, wherein the orifice mount is removably coupled within a receiving cavity of the nozzle main body by the coupler.

11. The nozzle system of claim 1, wherein the orifice mount includes a secondary port through which secondary fluid flows such that the secondary fluid and fluid jet are combined in the channel of the orifice mount.

12. The nozzle system of claim 1, wherein the orifice mount includes a tapered portion for contacting the nozzle main body.

13. The nozzle system of claim 12, wherein the tapered portion of the orifice mount and a complementary surface of the nozzle main body are both generally frusto-conical to facilitate self-centering of the orifice mount.

14. The nozzle system of claim 13, wherein a seal is formed when the orifice mount is pressed against the complementary surface of the nozzle main body.

15. The nozzle system of claim 1, further comprising:

a mixing chamber defining at least a portion of the downstream section of the fluid feed conduit and into which the media flowing through the media feed conduit combines with the fluid jet; and a secondary port connected to the mixing chamber and through which fluid is vented.

16. A high-pressure abrasive media fluid jet system including the nozzle system of claim 1 and further comprising:

a fluid source coupled to the fluid feed conduit of the nozzle main body of the nozzle system to deliver fluid thereto; and a media source coupled to the media feed conduit of the nozzle main body of the nozzle system to deliver abrasive media thereto.

17. A nozzle system for a high-pressure abrasive fluid jet delivery system, the nozzle system comprising:

a nozzle outlet for outputting an abrasive fluid jet from the nozzle system;

a nozzle orifice component positioned upstream of the nozzle outlet, the nozzle orifice component having an aperture configured to generate a fluid jet;

a fluid flow conduit having an upstream section positioned upstream of the nozzle orifice component and a downstream section positioned downstream of the nozzle orifice component, the upstream section comprising an angled elbow for receiving a fluid flow traveling in a first direction and outputting the fluid flow traveling in a second direction towards the nozzle orifice component, the first direction being different than the second direction;

a media flow conduit coupled to the downstream section of the fluid flow conduit, and the media flow conduit being configured to deliver abrasive media that mixes with the fluid jet generated by the aperture of the nozzle orifice component to form the abrasive fluid jet delivered out of the nozzle outlet;

an orifice mount positioned between the nozzle orifice component and the nozzle outlet, the orifice mount comprising a channel through which the fluid jet passes, a main body in contact with the nozzle orifice component, and a guide tube coupled to the main body, the guide tube defining at least a portion of the channel and comprising a material that is harder than a material of the main body.

18. The nozzle system of claim 17 wherein the guide tube comprises a nearly constant inner diameter over an axial length thereof.

19. The nozzle system of claim 17, further comprising:

a mixing chamber, and wherein a downstream end of the guide tube protrudes into the mixing chamber.

20. The nozzle system of claim 17 wherein the guide tube extends downstream of at least a portion of a downstream end of the media flow conduit with respect to a direction of travel of the fluid jet.

21. The nozzle system of claim 17 wherein the orifice mount includes a secondary port through which secondary fluid flows such that the secondary fluid and fluid jet are combined in the channel of the orifice mount.

22. The nozzle system of claim 17, further comprising:

a mixing chamber defining at least a portion of the downstream section of the fluid flow conduit and into which the media flowing through the media flow conduit combines with the fluid jet; and a secondary port connected to the mixing chamber and through which fluid is vented.

23. The nozzle system of claim 17 wherein the nozzle outlet and the nozzle orifice component are separated by a distance equal to or less than about 2 inches.

24. The nozzle system of claim 17 wherein the nozzle orifice component defines a centerline, and a distance between the centerline of the nozzle orifice component and an outer edge of an end of the nozzle system is equal to or less than about 0.5 inch.

25. The nozzle system of claim 17 wherein an upstream end and a downstream end of the guide tube are generally flush with respective faces of the orifice mount.

26. A nozzle system for a high-pressure abrasive fluid jet delivery system, the nozzle system comprising:

a nozzle outlet for outputting an abrasive fluid jet from the nozzle system;

a nozzle orifice positioned upstream of the nozzle outlet and configured to generate a fluid jet;

a fluid flow conduit having an upstream section positioned upstream of the nozzle orifice and a downstream section positioned downstream of the nozzle orifice, the upstream section comprising an angled elbow for receiving a fluid flow traveling in a first direction and outputting the fluid flow traveling in a second direction towards the nozzle orifice, the first direction being different than the second direction;

a media flow conduit coupled to the downstream section of the fluid flow conduit, and the media flow conduit being configured to deliver abrasive media that mixes with the fluid jet generated by the nozzle orifice to form the abrasive fluid jet delivered out of the nozzle outlet;

an orifice mount positioned between the nozzle orifice and the outlet, the orifice mount comprising a channel through which the fluid jet passes, a main body for engaging the nozzle orifice, and a guide tube coupled to the main body, the guide tube defining at least a portion of the channel and comprising a hardened material having a hardness that is greater than about 3 $R_c$ of the hardness of the main body.

* * * * *